US007751748B2

(12) United States Patent
Igarashi

(10) Patent No.: US 7,751,748 B2
(45) Date of Patent: Jul. 6, 2010

(54) IMAGE-FORMING DEVICE

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 392 days.

(21) Appl. No.: 11/326,404

(22) Filed: Jan. 6, 2006

(65) Prior Publication Data

US 2006/0153590 A1 Jul. 13, 2006

(30) Foreign Application Priority Data

Jan. 7, 2005 (JP) ..... 2005-003186

(51) Int. Cl.
*G03G 15/02* (2006.01)

(52) U.S. Cl. ..... 399/116; 399/117

(58) Field of Classification Search ..... 399/13, 399/26, 36, 113, 116–117
See application file for complete search history.

(56) References Cited

U.S. PATENT DOCUMENTS

| | | | | |
|---|---|---|---|---|
| 5,548,379 | A * | 8/1996 | Fukuchi et al. | 399/116 |
| 5,933,687 | A * | 8/1999 | Okuno et al. | 399/167 |
| 5,970,286 | A | 10/1999 | Numazu et al. | |
| 6,360,070 | B1 | 3/2002 | Taka et al. | |
| 6,438,341 | B1 * | 8/2002 | Matsuoka | 399/117 |
| 6,571,073 | B1 * | 5/2003 | Suzuki et al. | 399/116 |
| 2002/0110388 | A1 * | 8/2002 | Yokomori et al. | 399/167 |

FOREIGN PATENT DOCUMENTS

| | | |
|---|---|---|
| JP | 5-341586 | 12/1993 |
| JP | 7-199732 | 8/1995 |
| JP | 11-30893 | 2/1999 |
| JP | 11-167332 | 6/1999 |
| JP | 11-202715 | 7/1999 |
| JP | 11-258966 | 9/1999 |
| JP | 2000-35090 | 2/2000 |
| JP | 2000-137424 | 5/2000 |
| JP | 2000-293005 | 10/2000 |
| JP | 2000-293006 | 10/2000 |
| JP | 2000-298385 | 10/2000 |
| JP | 2000-310896 | 11/2000 |
| JP | 2000-310898 | 11/2000 |
| JP | 2000-330450 | 11/2000 |

(Continued)

OTHER PUBLICATIONS

English translation of Sato et al. (JP pub 2004-279937); published Oct. 7, 2004.*

(Continued)

*Primary Examiner*—David M Gray
*Assistant Examiner*—Geoffrey T Evans
(74) *Attorney, Agent, or Firm*—Banner & Witcoff, Ltd.

(57) ABSTRACT

An image-forming device includes a plurality of photosensitive drums, a plurality of drum gears, a plurality of drive gears and a removal allowing unit. Each drum gear has a first target portion. Each drive gear has a second target portion. The removal allowing unit allows each photosensitive drum to be removed from the casing only when the first target portion of the drum gear is positionally in coincidence with a first position and when the second target portion of the drive gear is positionally in coincidence with a second position.

20 Claims, 10 Drawing Sheets

FOREIGN PATENT DOCUMENTS

| | | | |
|---|---|---|---|
| JP | 2001-92194 | | 4/2001 |
| JP | 2001-154564 | | 6/2001 |
| JP | 2001-205908 | A | 7/2001 |
| JP | 2001-305820 | | 11/2001 |
| JP | 2002-14504 | | 1/2002 |
| JP | 2002-70956 | | 3/2002 |
| JP | 2003-43780 | | 2/2003 |
| JP | 2004-050438 | A | 2/2004 |
| JP | 2004-54119 | | 2/2004 |
| JP | 2004-054119 | A | 2/2004 |
| JP | 2004279937 | A * | 10/2004 |

OTHER PUBLICATIONS

JP Office Action dtd Feb. 2, 2010, JP Appln. 2005-003186, English Translation.

* cited by examiner

IMAGE-FORMING DEVICE

BACKGROUND OF THE INVENTION

1. Field of the Invention

The present invention relates to an image-forming device, and particularly to a tandem image-forming device.

2. Description of Related Art

Conventional tandem image-forming devices include photosensitive drums, drum gears being provided on the ends of the photosensitive drums, and drum drive gears and the like disposed on the image-forming device for driving the drum gears. However, these drum gears and drum drive gears are difficult to manufacture without errors in shape or dimension.

Such errors in the shape or dimension of the drum gear and drum drive gear cause the photosensitive drum on which the drum gear is mounted to rotate irregularly. When the image-forming device is a tandem-type device having a plurality of photosensitive drums, irregular rotations of the photosensitive drums may cause color registration problems in the image.

Since these photosensitive drums are generally treated as consumables that are discarded after use, the drum gear disposed on the end of the photosensitive drum is normally formed of a resin material in order to minimize the manufacturing cost of the photosensitive drum. However, due to the physical properties of the resin, a resin gear is even more prone to errors in shape and dimension.

To resolve this problem, an image-forming device proposed in Japanese unexamined patent application publication No. 2003-43780 tolerates the inevitable irregular rotations in the photosensitive drums and forms images by constantly synchronizing the image transfer position in the image transfer unit of each drum relative to one another. The proposed construction of this image-forming device is an effort to eliminate problems in color registration among the superimposed images.

In this construction, the engaged positions of drum gears to drum drive gears is adjusted in the factory prior to shipping the image-forming device to ensure that the rotational position (phase) is the same for each of the photosensitive drums. However, when a photosensitive drum has reached the end of its life and must be replaced, the drum gear mounted on each photosensitive drum must be replaced together with the photosensitive drum. Consequently, the new drum gear will likely engage with the drum drive gear at a different position.

SUMMARY OF THE INVENTION

In view of the above-described drawbacks, it is an objective of the present invention to provide an image-forming device of a tandem-type capable of preventing the engaged position of the drum drive gears and respective drum gears from becoming unknown should the gear system be stopped due to a sudden power outage or the like and the process unit removed from the body of the image-forming device in this state.

In order to attain the above and other objects, the present invention provides an image-forming device including a plurality of photosensitive drums, a plurality of drum gears, a scanning unit, a plurality of developing units, a transferring unit, a plurality of drive gears and a removal allowing unit.

Each photosensitive drum is in a cylindrical shape having a circumferential surface, a side surface and an axis extending from the side surface, each photosensitive drum being rotatable around the corresponding axis. The plurality of drum gears is provided in one-to-one correspondence with the plurality of photosensitive drums. Each drum gear is coaxially fixed to the axis of each photosensitive drum to be rotatable therewith. Each drum gear has drum gear teeth and a first target portion. The scanning unit exposes the circumferential surface of each photosensitive drum to light to form an electrostatic latent image thereon. The plurality of developing units is disposed in one-to-one correspondence with the plurality of photosensitive drums. Each developing unit stores a colored developer and supplies the corresponding circumferential surface with the developer to develop the corresponding latent image. The transferring unit transfers the developed image on the circumferential surface of each photosensitive drum onto an image receiving member.

The casing accommodates the plurality of photosensitive drums. The plurality of drive gears is disposed in one-to-one correspondence with the plurality of drum gears and provided on the casing. Each drive gear has drive gear teeth and a second target portion. The drive gear teeth are meshingly engagable with the drum gear teeth of the corresponding drum gear. The removal allowing unit allows each photosensitive drum to be removed from the casing only when the first target portion of the drum gear is positionally in coincidence with a first position and when the second target portion of the drive gear is positionally in coincidence with a second position.

BRIEF DESCRIPTION OF THE DRAWINGS

The above and other objects, features and advantages of the invention will become more apparent from reading the following description of the preferred embodiments taken in connection with the accompanying drawings in which:

FIG. 10(*b*) is a cross-sectional view along a line E-E in FIG. 10(*a*).

DETAILED DESCRIPTION OF THE PREFERRED EMBODIMENTS

Figure 1:
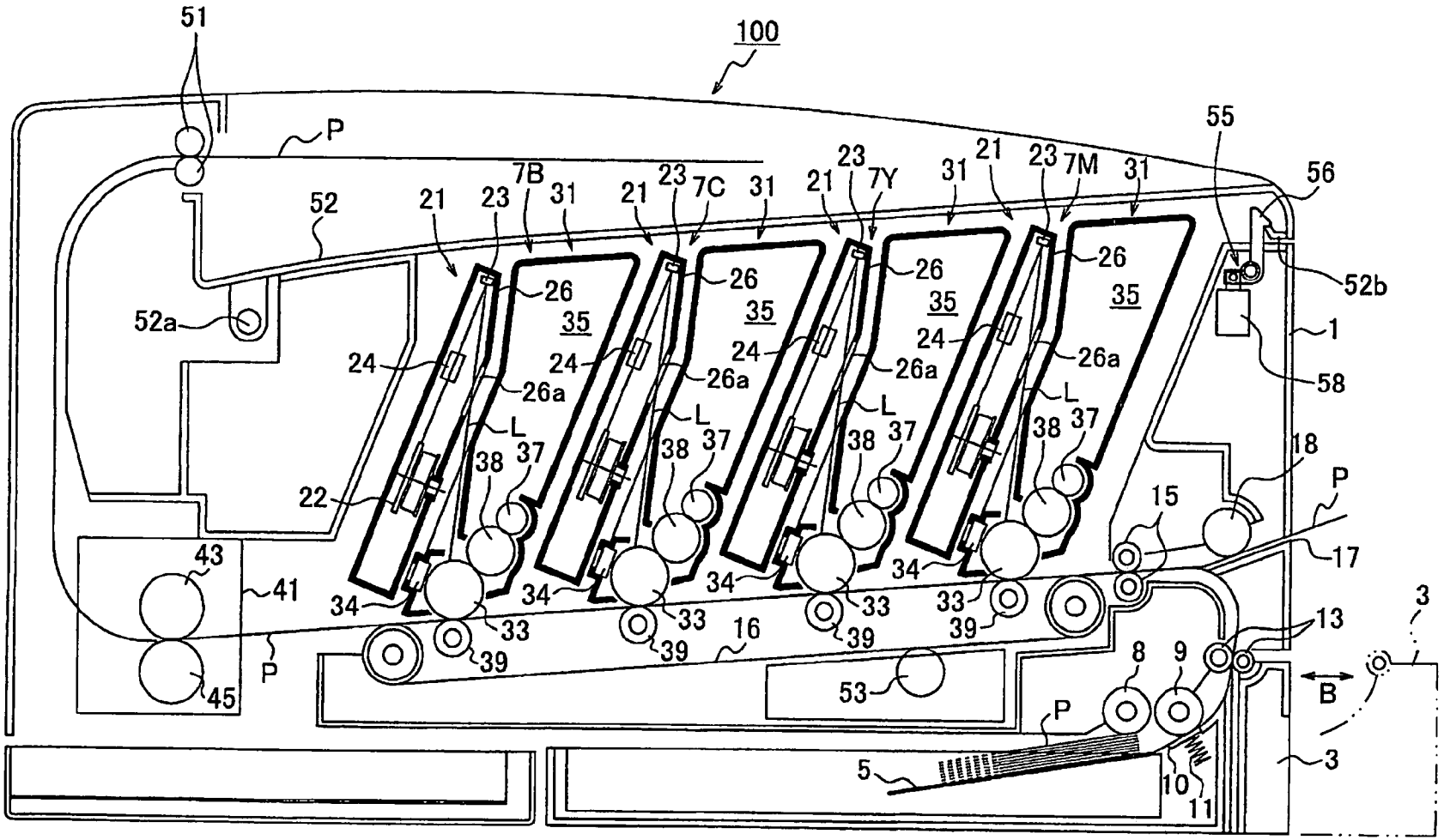
FIG. 1 is a side cross-sectional view showing the overall structure of a color laser printer according to a first embodiment of the present invention.

An image-forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image-forming device is disposed in an orientation in which it is intended to be used.

FIG. 1 is a side cross-sectional view showing the overall structure of a color laser printer 100 according to a first embodiment. As shown in FIG. 1, the color laser printer 100 includes a main frame 1 as an outer casing, and a paper cassette 3 that can be detachably inserted below the main frame 1. The paper cassette 3 can be inserted or removed in a horizontal direction indicated by the arrows B. In FIG. 1, the solid lines show the paper cassette 3 in a mounted position, and the broken line shows the paper cassette 3 being pulled from the mounted position toward a removal position. When the paper cassette 3 is pulled out to the removal position, the user can reload the paper cassette 3 with a recording paper P as desired.

A support plate 5 is provided in the paper cassette 3 for supporting the recording paper P stacked therein. A spring (not shown) urges the support plate 5 upward. A pair of feeding rollers 8 and 9 is disposed above the support plate 5 for separating and supplying the recording paper P stacked on the support plate 5 one sheet at a time to image-forming units 7M, 7Y, 7C, and 7B (hereinafter also collectively referred to as image-forming units 7) described later. The feeding roller 8 disposed to the left of the feeding roller 9 in FIG. 1 picks up and supplies the topmost sheet of recording paper P to the feeding roller 9. The feeding roller 9 disposed to the right of the feeding roller 8 in FIG. 1 functions as a pickup roller for separating and conveying the recording paper P one sheet at a time in cooperation with a separating pad 10 described later.

The feeding rollers 8 and 9, as well as other rollers, are rotatably disposed at prescribed positions on the main frame 1 and are driven to rotate by a common drive source that also drives the image-forming units 7. The separating pad 10 is supported in the paper cassette 3 by a spring 11. When the paper cassette 3 is inserted into the laser printer 100 to a prescribed position, the urging force of the spring 11 presses the separating pad 10 against the feeding roller 9.

The image-forming units 7M, 7Y, 7C, and 7B are disposed slightly above the center region of the main frame 1 for forming images corresponding to the colors magenta, yellow, cyan, and black respectively. Hereinafter, the letters M, Y, C, and B appended to indicate specific colors will be omitted from the image-forming units 7M, 7Y, 7C, and 7B unless a certain color is being specified. A pair of conveying rollers 13 for conveying the recording paper P and a pair of registration rollers 15 for registering and conveying the recording paper P are provided in the order given along the conveying path of the recording paper P leading from the feeding roller 9 to the image-forming units 7. The registration rollers 15 temporarily halt the sheet of recording paper P prior to the image-forming operation performed with the image-forming units 7, in order to correct misalignment in the recording paper P by engaging the leading edge of the recording paper P, and continue to convey the recording paper P toward the image-forming units 7.

A conveying belt 16 is disposed along the bottoms of the four image-forming units 7 for conveying the recording paper P that has passed through the registration rollers 15. As the conveying belt 16 conveys the recording paper P beneath the image-forming units 7, the image-forming units 7 form toner images in each color thereon. A manual feed slot 17 is formed in the lower side of the main frame 1 on which the paper cassette 3 is inserted and removed (hereinafter referred to as the "front side") for manually feeding recording paper P into the laser printer 100. The recording paper P supplied through the manual feed slot 17 is conveyed to a nip point between the registration rollers 15 by a manual feeding roller 18. Next, the conveying belt 16 conveys the recording paper P as images are formed thereon.

Each of the image-forming units 7 includes a scanning unit 21, and a process unit 31. The scanning unit 21 includes a laser diode (not shown) for emitting a laser beam L, a polygon mirror 22, a reflecting mirror 23, and an fθ lens 24 that are all accommodated in a casing 26 for each image-forming unit 7. The polygon mirror 22 reflects the laser beam L emitted from the laser diode so as to sequentially change the direction of the laser beam L along a prescribed surface. The reflecting mirror 23 reflects the laser beam L received from the polygon mirror 22 toward a photosensitive drum 33 described later disposed in the process unit 31. The fθ lens 24 is provided along the optical path of the laser beam L.

The casing 26 has an exposure opening 26*a* provided on the process unit 31 side to allow the laser beam L reflected as described above to pass through to the photosensitive drum 33. The reflecting mirror 23 is disposed near the top of the process unit 31 and is oriented to reflect the laser beam L back at an angle of 15 degrees to the optical path of the laser beam L prior to reflection so that the laser beam L passes through the exposure opening 26*a*.

With this construction, the scanning unit 21 and process unit 31 can be disposed in close proximity to achieve an overall compact device. Further, since the laser beam L is scanned from a point near the top of the scanning unit 21 toward the photosensitive drum 33, it is possible to allocate a sufficiently long optical path of the laser beam L, thereby reducing the size of the fθ lens 24 and the like and further reducing the size of the laser printer 100. Further, since the laser beam L is scanned from a point near the top of the scanning unit 21, the exposure opening 26*a* can be provided above the center of the scanning unit 21. Accordingly, it is possible to prevent toner from contaminating optical components such as a protective glass covering the exposure opening 26*a*.

Each of the process units 31 includes the photosensitive drum 33, and a Scorotron charger 34. The photosensitive drum 33 is rotatably disposed and has a photosensitive layer formed on the surface thereof. The charger 34 applies a uniform charge to the surface of the respective photosensitive drum 33. Each process unit 31 also includes a toner box 35 disposed above the photosensitive drum 33, a supply roller 37 disposed below the toner box 35, and a developer roller 38 that supply supplies toner to the surface of the photosensitive drum 33.

With this construction, the laser beam L emitted from the scanning unit 21 forms an electrostatic latent image on the surface of the photosensitive drum 33. Subsequently, the developer roller 38 supplies toner to the surface of the photosensitive drum 33 in order to develop the latent image. As the photosensitive drum 33 rotates in opposition to the transfer rollers 39 with the conveying belt 16 interposed therebetween, the transfer roller 39 applies a bias voltage to the toner that has developed the latent image on the photosensitive drum 33, causing the toner to be transferred onto the recording paper P being conveyed on the conveying belt 16. In this way, images in each of the colors magenta, yellow, cyan, and black are sequentially formed on the recording paper P.

After passing by the image-forming units 7, the recording paper P is conveyed to a fixing unit 41. The fixing unit 41 includes a heating roller 43 and a pressure roller 45 for fixing the toner formed on the recording paper P with heat as the recording paper P passes between the heating roller 43 and pressure roller 45. After the image has been fixed, the recording paper P is further conveyed by a pair of discharge rollers 51. The discharge rollers 51 discharge the recording paper P onto a discharge tray 52 provided on the top surface of the main frame 1. A cleaning roller 53 is also provided in contact with the bottom surface of the conveying belt 16 for recovering toner scattered from the photosensitive drums 33 and deposited on the surface of the conveying belt 16.

Hinges 52*a* are provided below the discharge rollers 51, enabling the entire discharge tray 52 to be rotated upward. Hence, the discharge tray 52 can be opened and closed about the hinges 52*a*. A locking mechanism 55 is provided on a free end (front edge) of the discharge tray 52 for locking the discharge tray 52 on the main frame 1.

The locking mechanism 55 is configured of a pawl 56 provided on the main frame 1, and a solenoid 58 for operating the pawl 56. The solenoid 58 is controlled by commands from a controller 81 (see FIG. 4) described later. The pawl 56 locks the discharge tray 52 in a closed state by engaging with a front edge 52*b* of the discharge tray 52.

When electricity is supplied to the solenoid 58, the locking mechanism 55 is in a non-locked state (OFF state) in which the pawl 56 is not engaged with the front edge 52*b* of the discharge tray 52. When electricity is not supplied to the solenoid 58, the locking mechanism 55 is in a locked state (ON state) in which the pawl 56 is capable of engaging with the front edge 52*b* of the discharge tray 52. Hence, the locked state is maintained in the event of a power outage in which power is no longer supplied to the controller 81 and the solenoid 58. Accordingly, electricity is supplied to the solenoid 58 to put the locking mechanism 55 in a non-locked state (OFF state) only when electricity is supplied to the controller 81 and the controller 81 determines that the lock may be released.

Figure 3A:
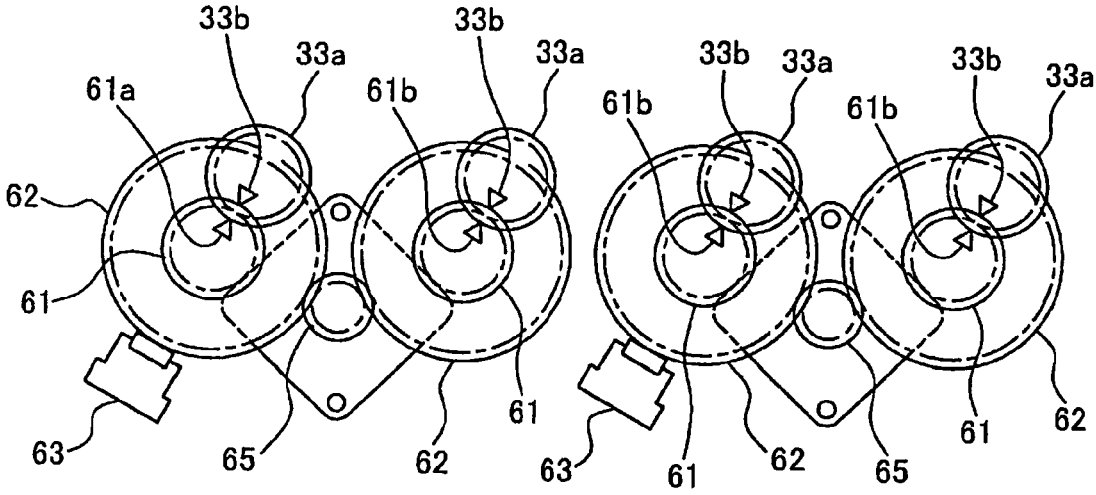
FIGS. 3(*a*) and 3(*b*) are side views showing drum gears in drum gear removing positions and drum drive gears in drum drive gear removing positions.
Figure 3B:
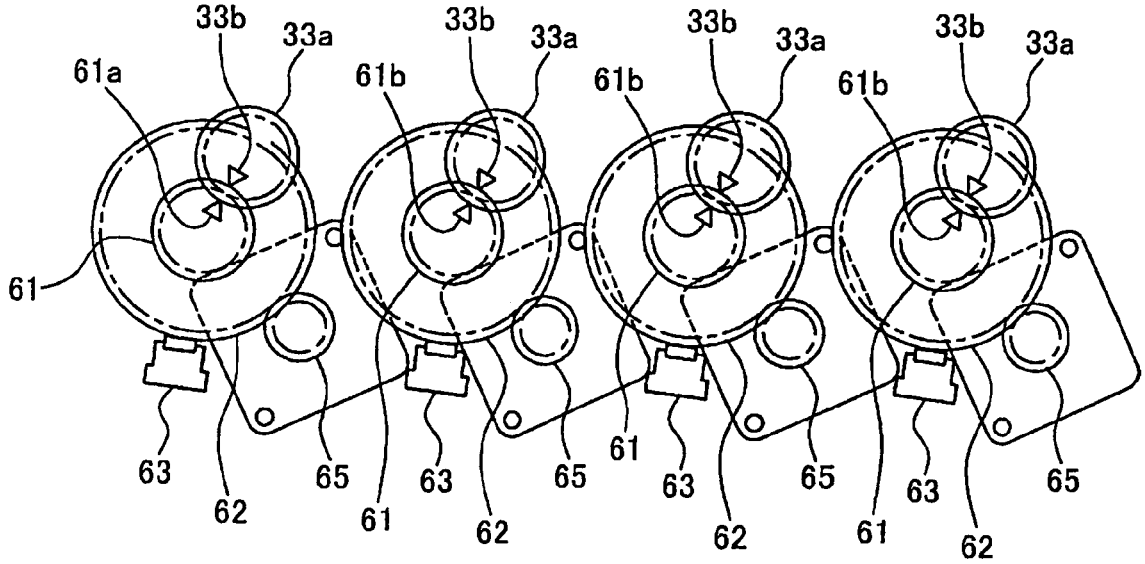

Specifically, each drum 33 is provided with a drum gear 33*a*. A drum drive gear 61, a sensor 63 and a motor 65 for each drum 33 are provided on the main frame 1 (FIG. 3). The drum gear 33*a* is engaged with the drum drive gear 61. The sensor 63 detects the rotational position of the drum drive gear 61. When the sensor 63 detects that the drum drive gear 61 is in the drum drive gear removing position, the controller 81 determines that the lock may be released and controls the motor 65 to drive the drum drive gear 61 in order to put the locking mechanism 55 in a non-locked state (OFF state). The controller 81, the sensor 63 and the locking mechanism 55 configure a removal allowing mechanism 80 (FIG. 4) that performs the above-described operation.

Figure 2A:
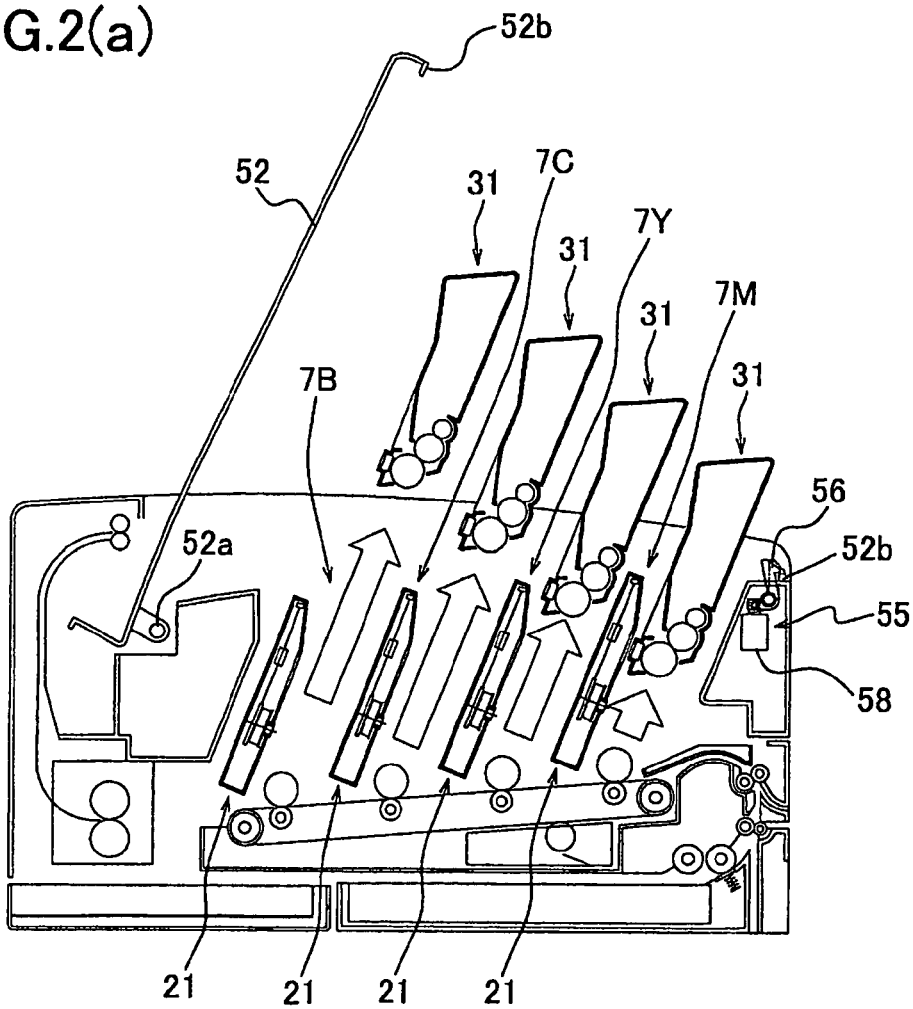
FIGS. 2(*a*) and 2(*b*) are side views showing a discharge tray on the color laser printer in open and closed states.
Figure 2B:
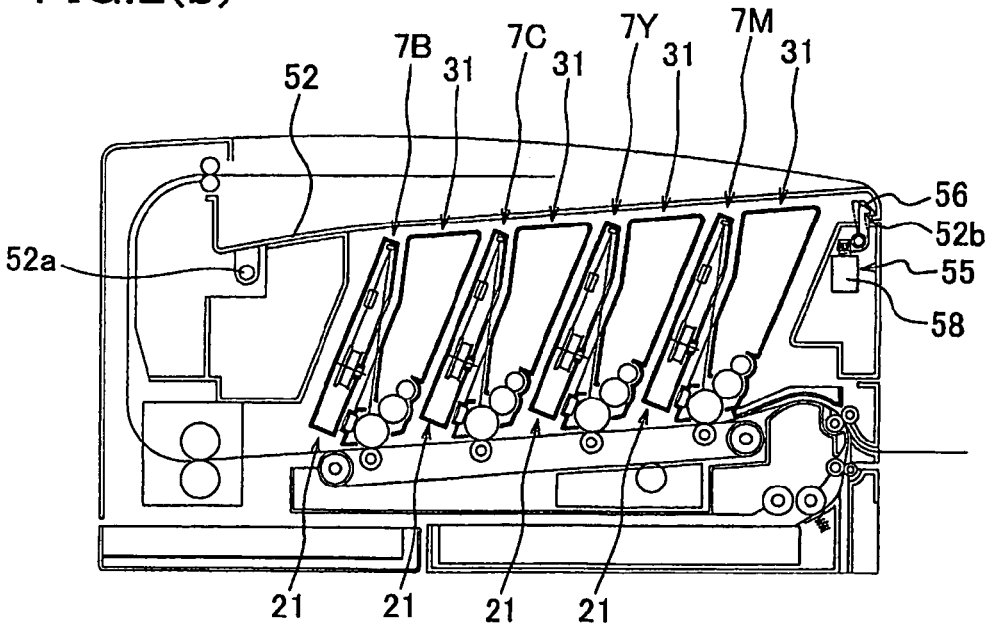

Next, the removal allowing mechanism 80 will be described with reference to FIGS. 2 and 3. FIG. 2 shows open and closed states of the discharge tray 52 as allowed by a removal allowing mechanism 80. FIG. 3 shows the drum gears 33*a* in the drum gear removing positions and drum drive gears 61 in the drum drive gear removing positions.

FIG. 3(*a*) shows an arrangement in which two motors 65 are provided for driving four drum drive gears 61. In this case, two of the sensors 63 are used for detecting the rotational positions of the drum drive gears 61. FIG. 3(*b*) shows an example of providing four dedicated motors 65 for driving the four drum drive gears 61. In this case, four sensors 63 are used for detecting the rotational position of each drum drive gear 61. Although not shown in the drawings, it is also possible to provide a single motor for driving the four drum drive gears 61, in which case a single sensor 63 may be used for detecting the rotational position of the drum drive gears 61.

Next, the example of FIG. 3(*a*) will be described. A description of the example in FIG. 3(*b*) will not be included, as the only difference is the number of sensors 63. As shown in FIG. 3(*a*), drum gears 33*a* are engaged with the drum drive gears 61 provided in the body of the laser printer 100. The drum gears 33*a* are set with a predetermined drum gear removing position. Similarly, the drum drive gears 61 are set with a predetermined drum drive gear removing position.

The removing positions for the drum gears 33*a* and drum drive gears 61 denote the rotational positions of these gears in which the pairs of gears can be disengaged, allowing the process unit 31 to be removed. In the preferred embodiment, the removing position of the drum gears 33*a* and drum drive gears 61 correspond to the rotational positions of the drum gears 33*a* and drum drive gears 61 when triangular marks 33*b* on the drum gears 33*a* and triangular marks 61*b* on the drum drive gears 61 are aligned, as shown in FIG. 3(*a*). The triangular marks 33*b* and 61*b* have been provided for description purposes. In the following description, the rotational positions of the drum gears 33*a* and the drum drive gears 61 when the triangular marks 33*b* are aligned with the triangular marks 61*b* will be described as the drum gear removing positions 33*b* and the drum drive gear removing positions 61*b*.

Intermediate gears 62 are coaxially fixed on each of the drum drive gears 61 and rotate together with the drum drive gears 61. The motors 65 disposed in the body of the laser printer 100 drive the intermediate gears 62 to rotate. The sensors 63 are disposed near the peripheral edge of the intermediate gears 62 for detecting the rotational positions of the drum drive gears 61. Both FIGS. 3(*a*) and 3(*b*) show the drum gears 33*a* in the drum gear removing positions 33*b* and the drum drive gears 61 in the drum drive gear removing positions 61*b*.

When the drum gears 33*a* are in the drum gear removing positions 33*b* and the drum drive gears 61 are in the drum drive gear removing positions 61*b*, the locking mechanism 55 is in the OFF state so that the user can lift up the discharge tray 52, as shown in FIG. 2(*a*). From this state, the user can remove the photosensitive drum 33 together with the process unit 31 through an opening formed in the laser printer 100. FIG. 2(*b*) shows the locking mechanism 55 in the ON state, at which time the user cannot open the discharge tray 52.

Figure 4:
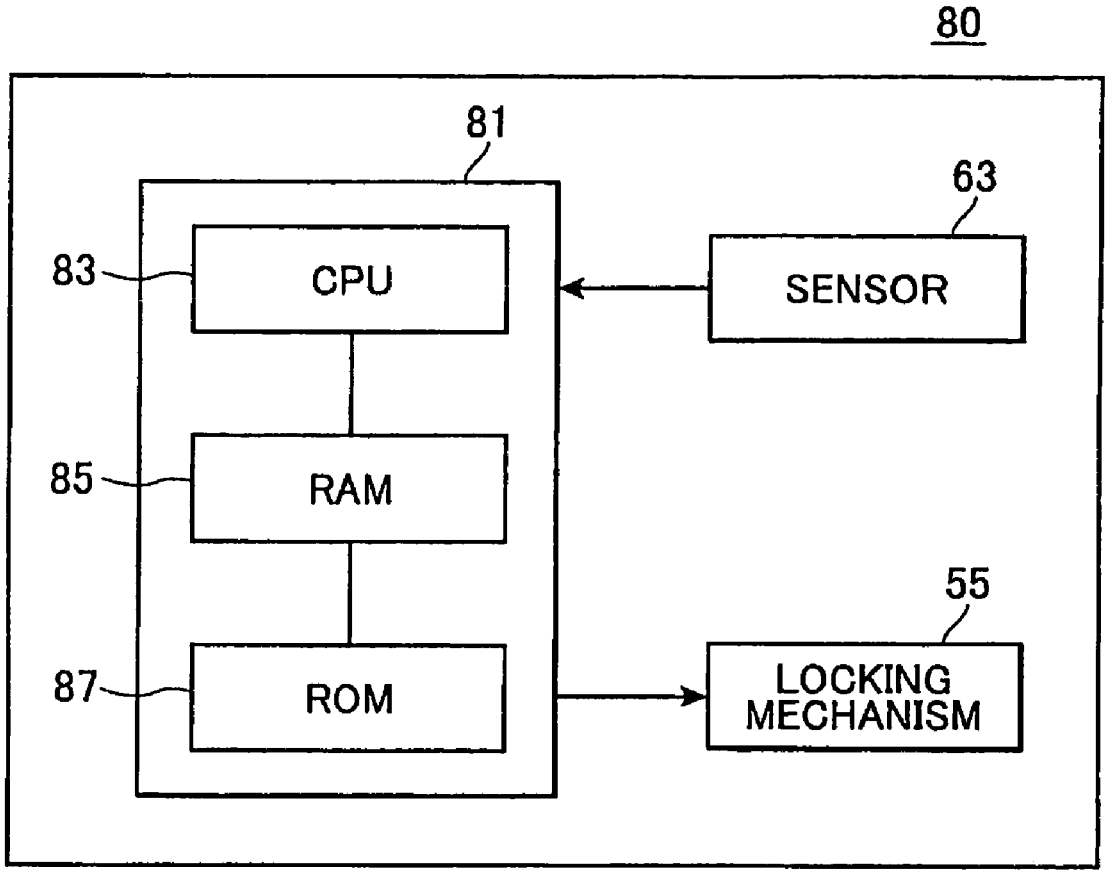
FIG. 4 is a block diagram illustrating a removal allowing mechanism.
Figure 5:
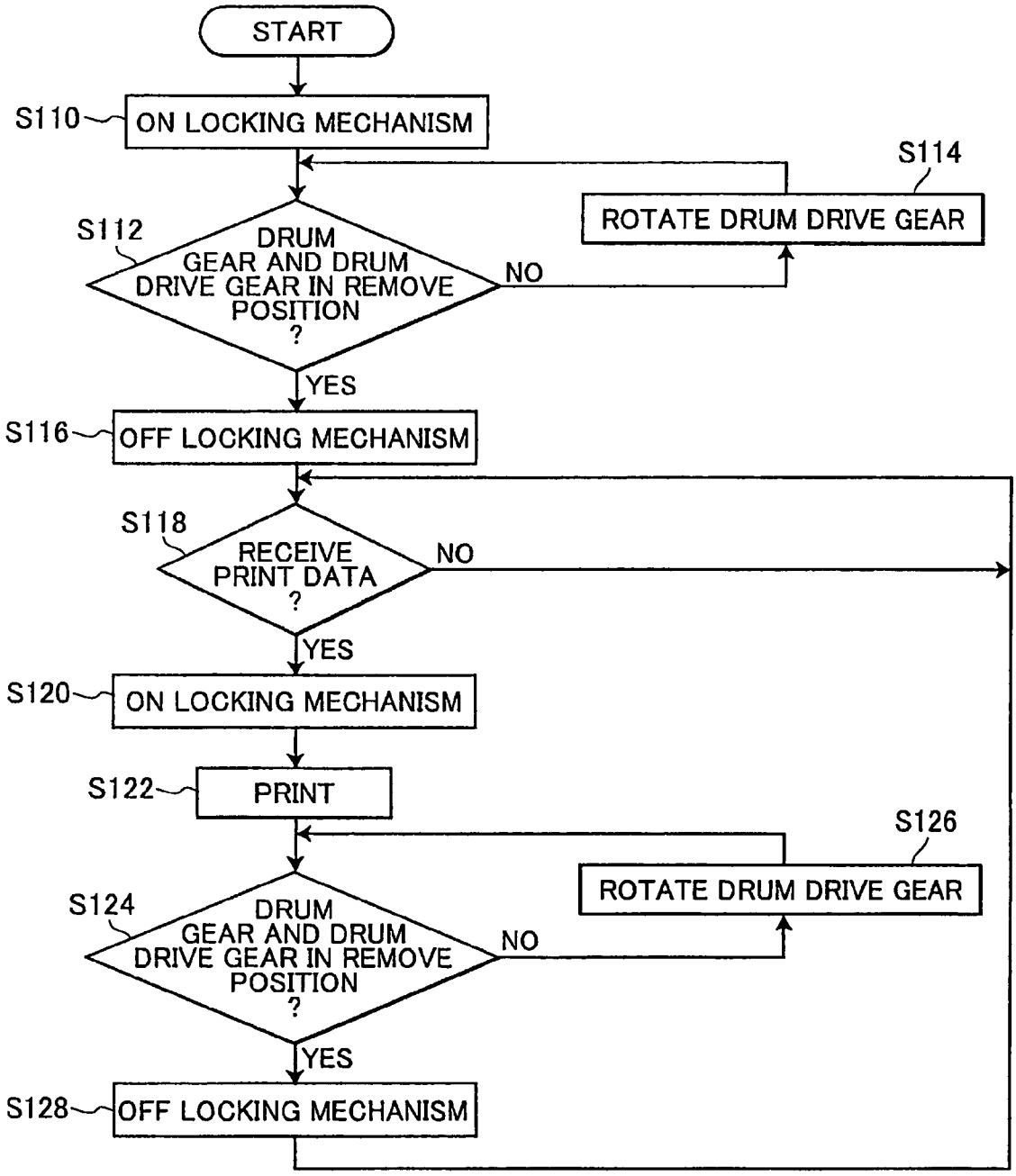
FIG. 5 is a flowchart illustrating steps in an operation of the removal allowing mechanism.

Next, operations of the removal allowing mechanism 80 will be described with reference to FIGS. 4 and 5. FIG. 4 is a block diagram showing the structure of the removal allowing mechanism 80. FIG. 5 is a flowchart illustrating steps in the operations of the removal allowing mechanism 80.

As shown in FIG. 4, the removal allowing mechanism 80 includes the sensors 63, the controller 81, and the locking mechanism 55. The controller 81 receives detection signals from the sensors 63 and outputs commands for switching the locking mechanism 55 on and off based on the detection signals. The controller 81 is disposed in the body of the laser printer 100 and functions to perform computations on detection signals received from the sensors 63 when the sensors 63 detect the rotational positions of the drum drive gears 61 and to indicate the results of these computations to the locking mechanism 55. The controller 81 includes a CPU 83, a RAM 85, and a ROM 87.

The CPU 83 receives the signals inputted from the sensors 63, performs the required computations, and outputs the results to the locking mechanism 55. The RAM 85 is a random access memory for temporarily storing data and the like required for the computations performed by the CPU 83. The ROM 87 is a read only memory for storing instructions and the like for the computational process.

Next, steps in the operations performed by the removal allowing mechanism will be described with reference to the flowchart in FIG. 5. As shown in FIG. 5, in Step 110 (hereinafter, Step will be abbreviated as "S") the locking mechanism 55 is set to the ON state when the power of the laser printer 100 is turned on. More specifically, although the locking mechanism 55 is in the ON state when the power of the laser printer 100 is off, in S110 the locking mechanism 55 remains in the ON state when the power to the laser printer 100 is turned on. Therefore, the user cannot open the discharge tray 52 and cannot remove the photosensitive drums 33 from the body of the laser printer 100.

In S112 the controller 81 (more specifically, the CPU 83) determines whether the drum gears 33*a* and the drum drive gears 61 are in the removing positions. Specifically, the controller 81 determines whether the drum gears 33*a* and drum drive gears 61 are in the positions shown in FIG. 3(*a*) based on detection signals received from the sensors 63. If the drum gears 33*a* and drum drive gears 61 are halted in the removing positions (S112: YES), then in S116 the controller 81 immediately sets the locking mechanism 55 to the OFF state.

However, if the drum gears 33*a* and drum drive gears 61 are not in the removing positions when the power is turned on (S112: NO), then in S114 the controller 81 drives the drum gears 33*a* and drum drive gears 61 to rotate to the removing position. More specifically, the controller 81 drives the motors 65 based on detection signals from the sensors 63 to rotate the drum drive gears 61 to the removing positions shown in FIG. 3(*a*). Subsequently, the controller 81 sets the locking mechanism 55 to OFF in S116. In S118 the controller 81 waits until a print command is received from an external device, such as a host computer connected to the laser printer 100.

While the locking mechanism 55 is in the OFF state, the user can lift up the discharge tray 52 as needed and can, thus, remove the process units 31 provided with the photosensitive drums 33 by lifting the process units 31 up through the opening in the laser printer 100.

When a print command is received from an external device (S118: YES), then in S120 the controller 81 sets the locking mechanism 55 to the ON state and in S122 executes a printing operation by controlling the driving of the motors 65 and the like. Accordingly, the discharge tray 52 cannot be opened when a printing process is being performed. Therefore, this construction reliably prevents the process units 31 from being removed when the drum gears 33*a* and drum drive gears 61 are not in the removing positions.

After completing the printing process in S122 based on print commands from the external device, in S124 the controller 81 determines whether the drum gears 33*a* and the drum drive gears 61 are in the removing positions.

If the drum gears 33*a* and drum drive gears 61 are halted in the removing positions (S124: YES), then in S128 the controller 81 immediately sets the locking mechanism 55 to the OFF state. However, if the drum gears 33*a* and drum drive gears 61 are not in the removing positions when the power is turned on (S124: NO), then in S126 the controller 81 drives the drum gears 33*a* and drum drive gears 61 to rotate to the removing position.

After confirming that the drum gears 33*a* and drum drive gears 61 have stopped in the removing positions (S124: YES), the controller 81 again sets the locking mechanism 55 to the OFF state in S126 and subsequently returns to S118 to wait for another printing command from an external device.

Note that if a power outage or the like occurs abruptly during a printing operation or when the controller 81 is in the standby state, the locking mechanism 55 remains in the ON state during the power outage. Accordingly, the locking mechanism 55 prevents the discharge tray 52 from being opened.

With this construction, the photosensitive drums 33 cannot be removed from the body of the laser printer 100 during a power outage or the like, even though the gear system is halted. Hence, this construction prevents the engaged positions of the drum drive gears 61 and drum gears 33*a* from becoming unknown.

Further, the photosensitive drums 33 can only be mounted in the body of the laser printer 100 when the drum gears 33*a* are rotated to the drum gear removing positions 33*b* and when the drum drive gears 61 are rotated to the drum drive gear removing positions 61*b*.

When the function of the photosensitive drum 33 declines, it is necessary to replace the process unit 31 provided with the photosensitive drum 33 with a new unit. If a process unit 31 equivalent to the process unit 31 originally provided in the laser printer 100 is available as a replacement part, it is possible to ensure that the engaged position (phase) of the drum gear 33*a* and drum drive gear 61 is properly set when the process unit is replaced.

Figure 6A:
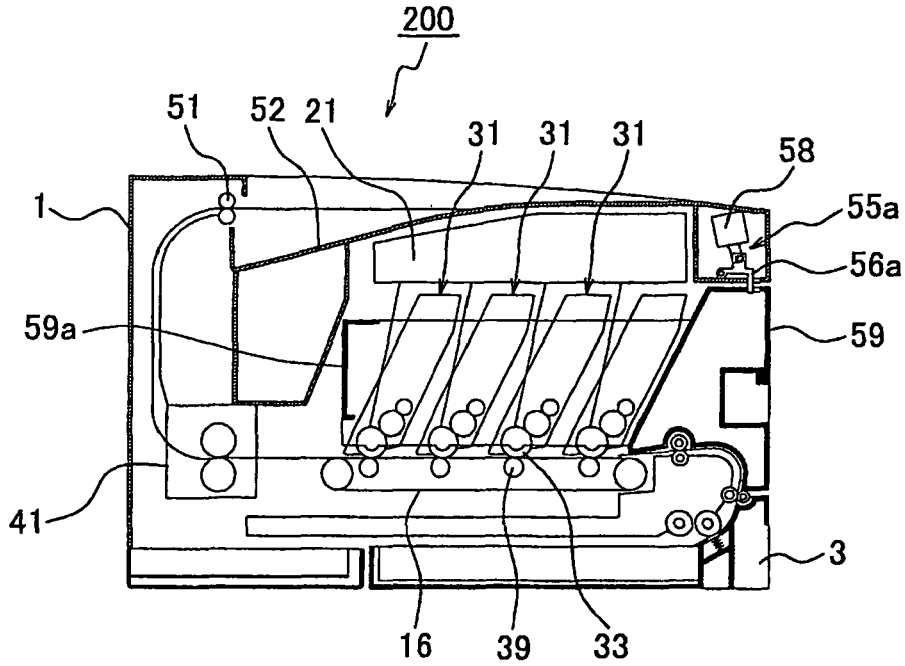
FIGS. 6(*a*) and 6(*b*) are side views showing a color laser printer according to a second embodiment.
Figure 6B:
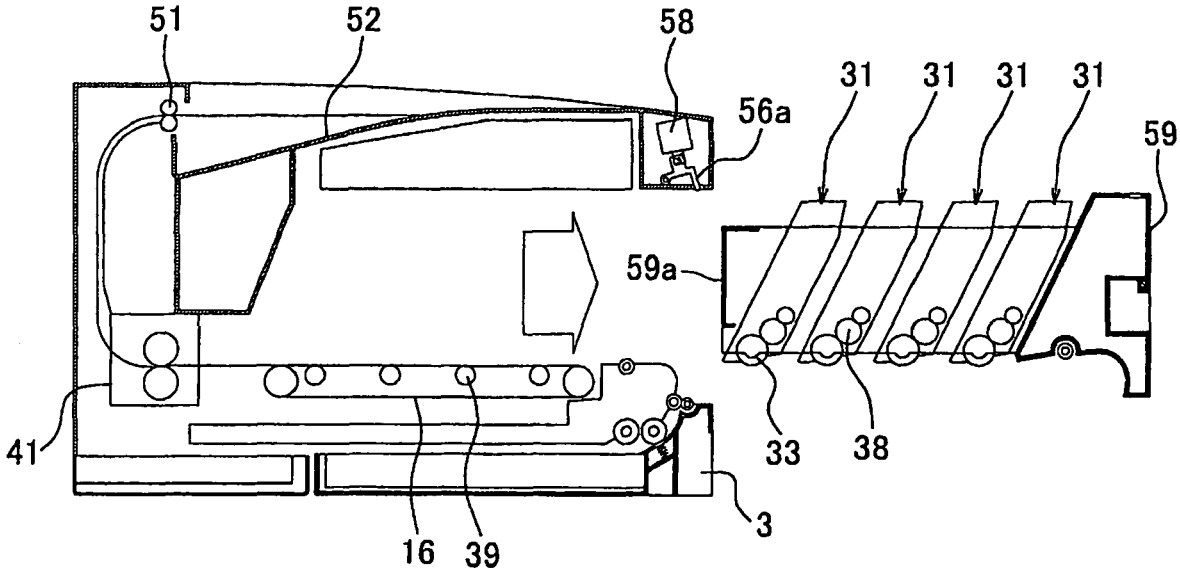

Next, a color laser printer 200 according to a second embodiment of the present invention will be described. As shown in FIG. 6, the laser printer 200 according to the second embodiment is provided with a front panel 59 on the front side surface of the main frame 1, and a process unit casing 59*a* integrally provided with the front panel 59 for accommodating the process units 31. Hence, the process units 31 can be removed through the front side of the laser printer 200 while accommodated in the process unit casing 59*a*.

Although the laser printer 200 also differs from the laser printer 100 of the first embodiment primarily in the shape and arrangement of the scanning unit 21 and the accommodating sections for the process units 31, these structures will not be described in detail herein as the structures are not directly related to the relevant points in the present invention.

As shown in FIG. 6(*a*), the front panel 59 is engaged with the main frame 1 by a pawl 56*a* of a locking mechanism 55*a*. The pawl 56*a* is operated by the solenoid 58. The controller for operating the solenoid 58 is identical to that described in the first embodiment. Hence, the locking mechanism 55*a* is in an OFF state only when the drum gears are in the drum gear removing positions and the drum drive gears are in the drum drive gear removing positions. At this time, the user can pull the front panel 59 from the front surface of the laser printer 200 and remove the process units 31 together with the photosensitive drums 33 upward from the process unit casing 59*a*.

Since the locking mechanism 55*a* remains locked in the event of a sudden power outage or the like, the process units 31 cannot be removed from the body of the laser printer 200, even though the gear system is halted. Accordingly, this construction can prevent the engaged positions of the drum drive gears 61 and drum gears 33*a* from being unknown.

Figure 7A:
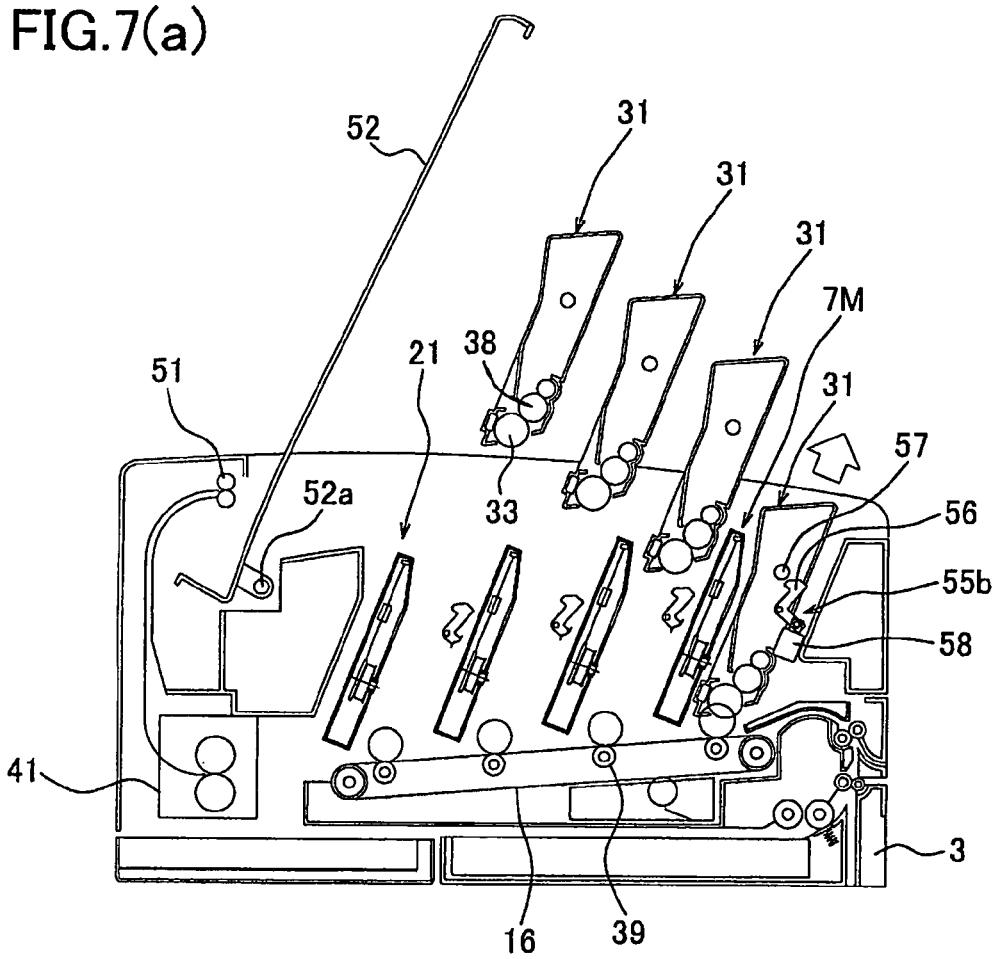
FIGS. 7(*a*) and 7(*b*) are side views showing a color laser printer according to a third embodiment.
Figure 7B:
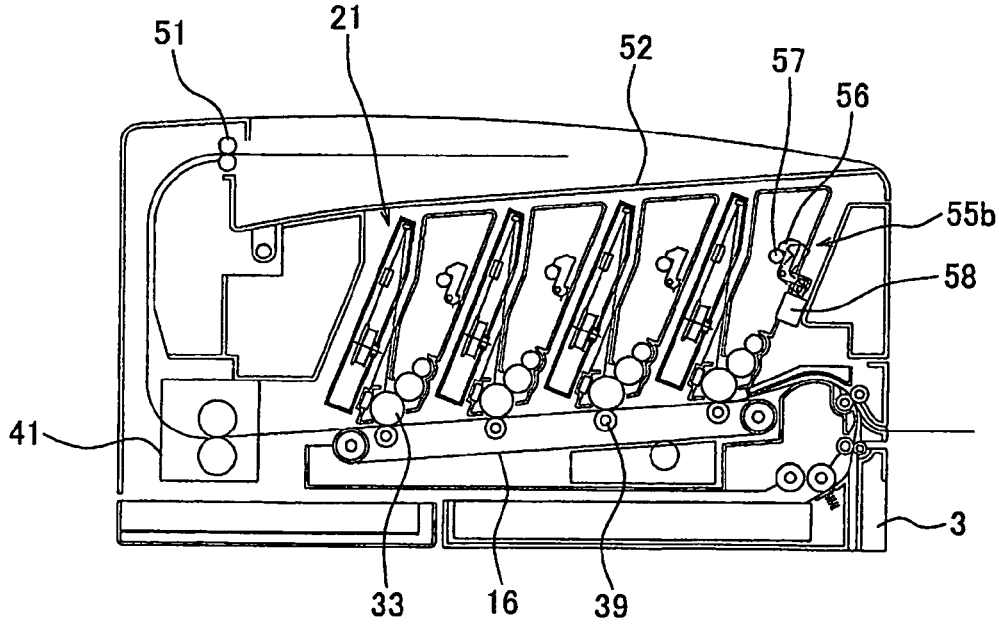

Next, a color laser printer 300 according to a third embodiment of the present invention will be described with reference to FIG. 7. The laser printer 300 according to the third embodiment differs from the laser printer 100 of the first embodiment only in the mounting position of a locking mechanism 55*b*. As shown in FIG. 7(*a*), the locking mechanism 55*b* is disposed in the body of the laser printer 300 for each of the process units 31. As shown in FIG. 7(*b*), each process unit 31 is engaged with a rod 57 by the pawl 56 of the locking mechanism 55*b*. The pawl 56 is operated by the solenoid 58. The controller for operating the solenoid 58 is identical to that described in the first embodiment.

The locking mechanism 55*b* is set to the OFF state only when the drum gear is in the drum gear removing position and the drum drive gear is in the drum drive gear removing position. At this time, the user can open the discharge tray 52 and remove the process unit 31 together with the photosensitive drum 33 upward through the opening in the laser printer 300.

With this construction, the locking mechanism 55*c* remains in a locked state in the event of a sudden power outage or the like. Therefore, the process unit 31 cannot be removed from the laser printer 300, even though the gear system is halted and the discharge tray 52 is opened. Hence, the construction described above can prevent the engaged position of the drum drive gear 61 and drum gear 33*a* from becoming unknown.

Next, a rotation halting mechanism 60 according to a fourth embodiment of the present invention will be described with reference to FIG. 8. In the fourth embodiment, the rotation halting mechanism 60 halts rotations of the drum gear 33*a* in the process unit 31 when the process unit 31 has been removed from the body of the laser printer.

When the process unit 31 is removed from the body of the laser printer, the rotational position of the drum gear 33*a* is in the drum gear removing positions 33*b*. However, after removing the process unit 31 from the body of the printer, if the user accidentally touches the drum gear 33*a* or hits the drum gear 33*a* against a hard object, the rotational position of the drum gear 33*a* could change from the drum gear removing positions 33*b*. If the drum gear 33*a* changes from the drum gear removing positions 33*b* at this time, the engaged position of the drum gear 33*a* and drum drive gear 61 will be shifted when the process unit 31 is again mounted in the body of the printer. A shift in the engaged position may result in color registration problems in the image formed on the recording paper P, resulting in a decline in image quality. The rotation halting mechanism 60 shown in FIG. 8 prevents such problems.

Figure 8A:
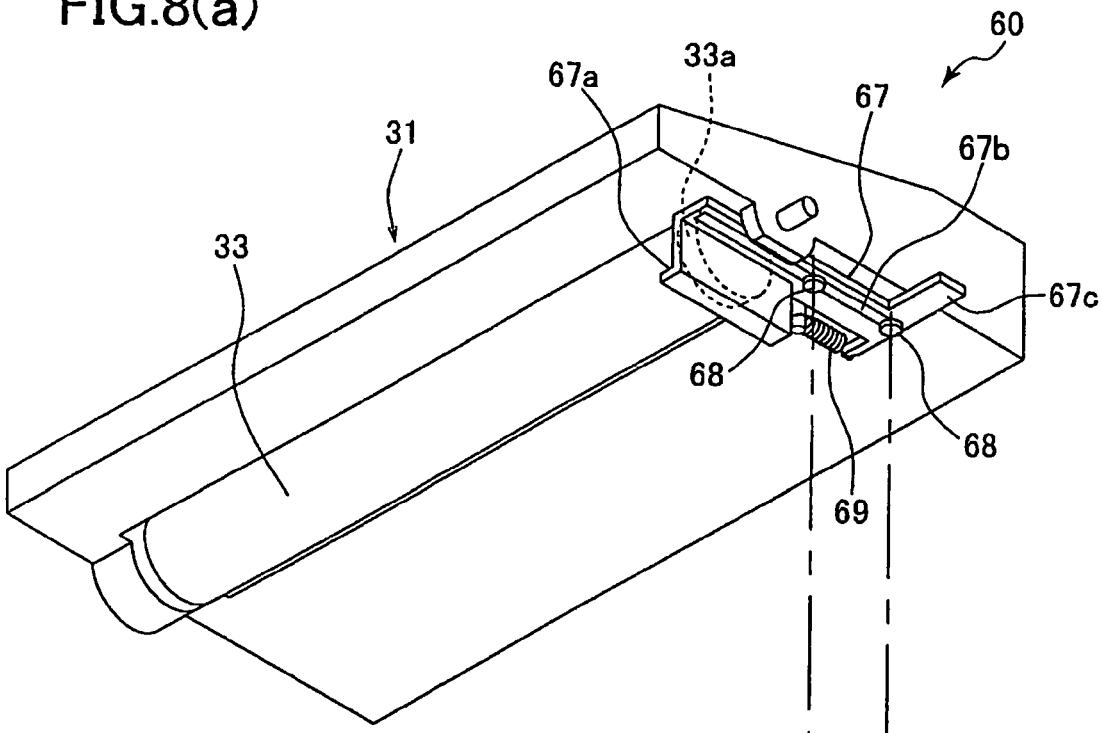
FIGS. 8(*a*) and 8(*b*) are perspective views illustrating a rotation halting mechanism.
Figure 8B:
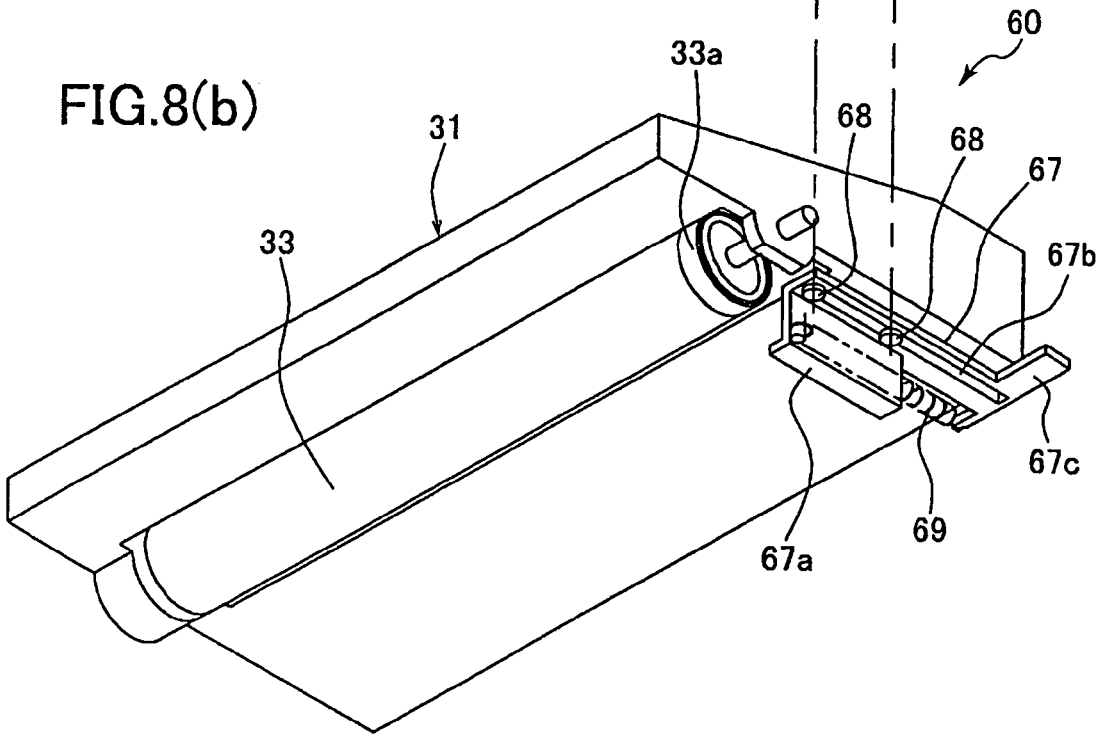

As shown in FIG. 8, the rotation halting mechanism 60 includes a cover member 67 disposed on the outer surface of the process unit 31 for covering the drum gear 33*a*, two pins 68 protruding from the outer surface of the process unit 31 and a spring 69 fixed on one end to a right edge of the cover member 67 in FIG. 8 and on the other end to the process unit 31. The cover member 67 may also be disposed to cover the photosensitive drum 33, as well as the drum gear 33*a*.

The cover member 67 is a plate member including a cover plate 67*a* that has a L-shaped cross section. The cover plate 67*a* is formed at a size capable of covering the drum gear 33*a*. The cover member 67 also includes a guide groove 67*b* extending across nearly the entire length of the cover member 67. Two pins 68 are fitted into the guide groove 67*b*. Accordingly, the cover member 67 is capable of moving within the range that the pins 68 can slide within the guide groove 67*b*. The spring 69 urges the cover member 67 in a direction for covering the drum gear 33*a* with the cover plate 67*a*. A protruding piece 67*c* is provided on the cover member 67 and protrudes outward from the process unit 31. The protruding piece 67*c* moves the cover member 67 against the urging force of the spring 69 when being provided with a force from the user.

With this construction, the cover plate 67*a* covers the drum gear 33*a*, as shown in FIG. 8(*a*), when the piece 67*c* is not provided with the force from the user. Therefore, the cover plate 67*a* prevents the user from accidentally touching the drum gear 33*a* or bumping the drum gear 33*a* against a hard object, thereby preventing the drum gear 33*a* from shifting from the drum gear removing positions 33*b*.

When the process unit 31 is mounted in the body of the printer, the protruding piece 67*c* contacts part of the body of the printer, moving the cover member 67 via the guide groove 67*b* so that the cover plate 67*a* covering the drum gear 33*a* is moved away from the drum gear 33*a*, as shown in FIG. 8(*b*). Accordingly, the drum gear 33*a* can engage with the drum drive gear 61 without shifting from the drum gear removing positions 33*b*.

Figure 9A:
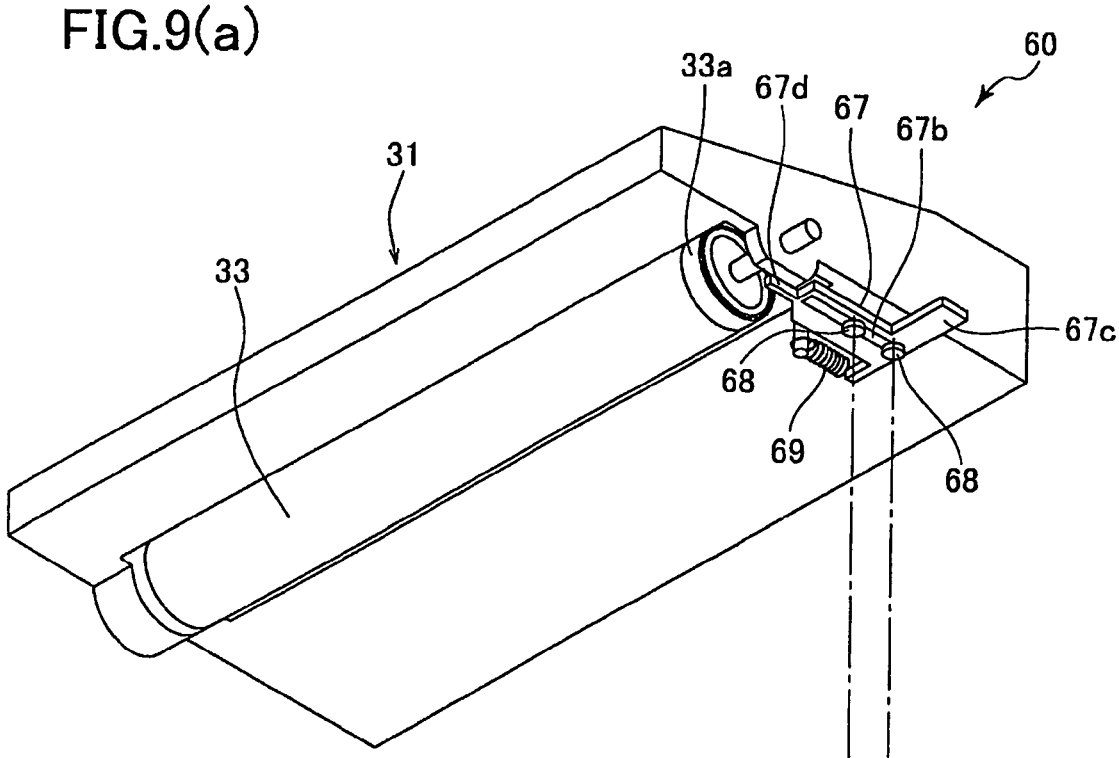
FIGS. 9(*a*) and 9(*b*) are perspective views illustrating another rotation halting mechanism.
Figure 9B:
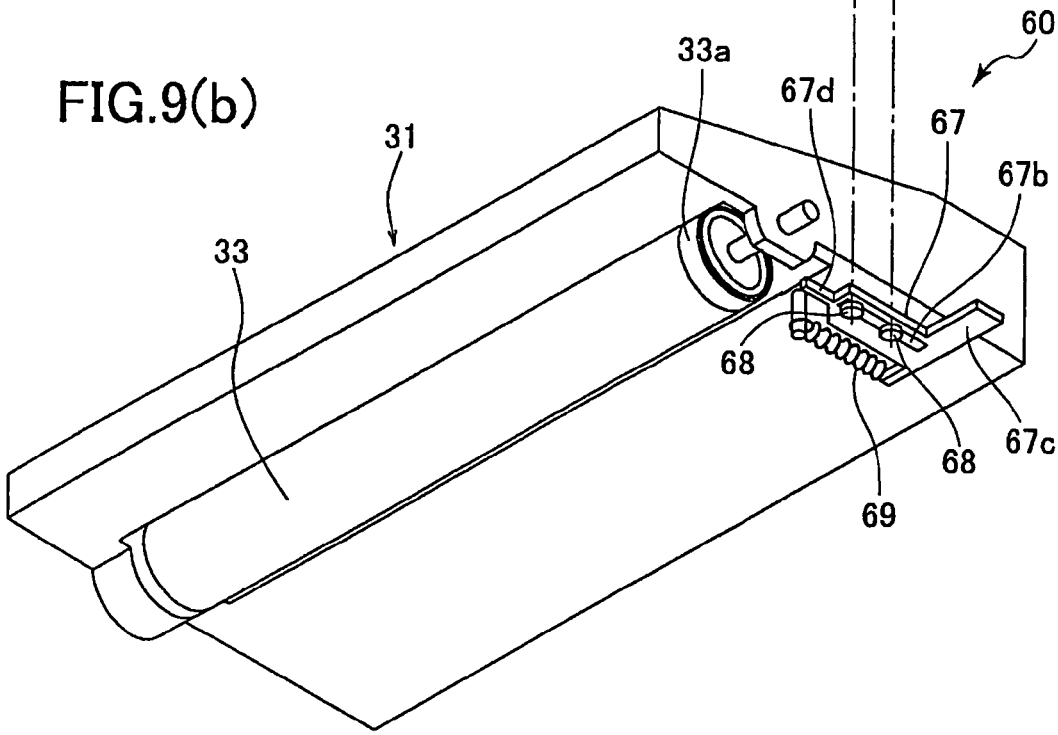

As shown in FIG. 9, it is possible to provide an engaging pawl 67*d* in place of the cover plate 67*a* for engaging with the drum gear 33*a* to prevent the drum gear 33*a* from rotating accidentally when the process unit 31 is removed from the body of the printer. Obviously, the engaging pawl 67*d* should disengage from the photosensitive drum 33 when the process unit 31 is remounted in the body of the printer so that the photosensitive drum 33 can rotate freely, as shown in FIG. 9(*b*).

Next, an error position preventing mechanism 70 will be described according to a fifth embodiment of the present invention with reference to FIG. 10. The error position preventing 70 according to the fifth embodiment prevents the drum gear 33*a* in a rotational position different from the drum gear removing position 33*b* from engaging the drum drive gear 61 when the photosensitive drum 33 is replaced.

Figure 10A:
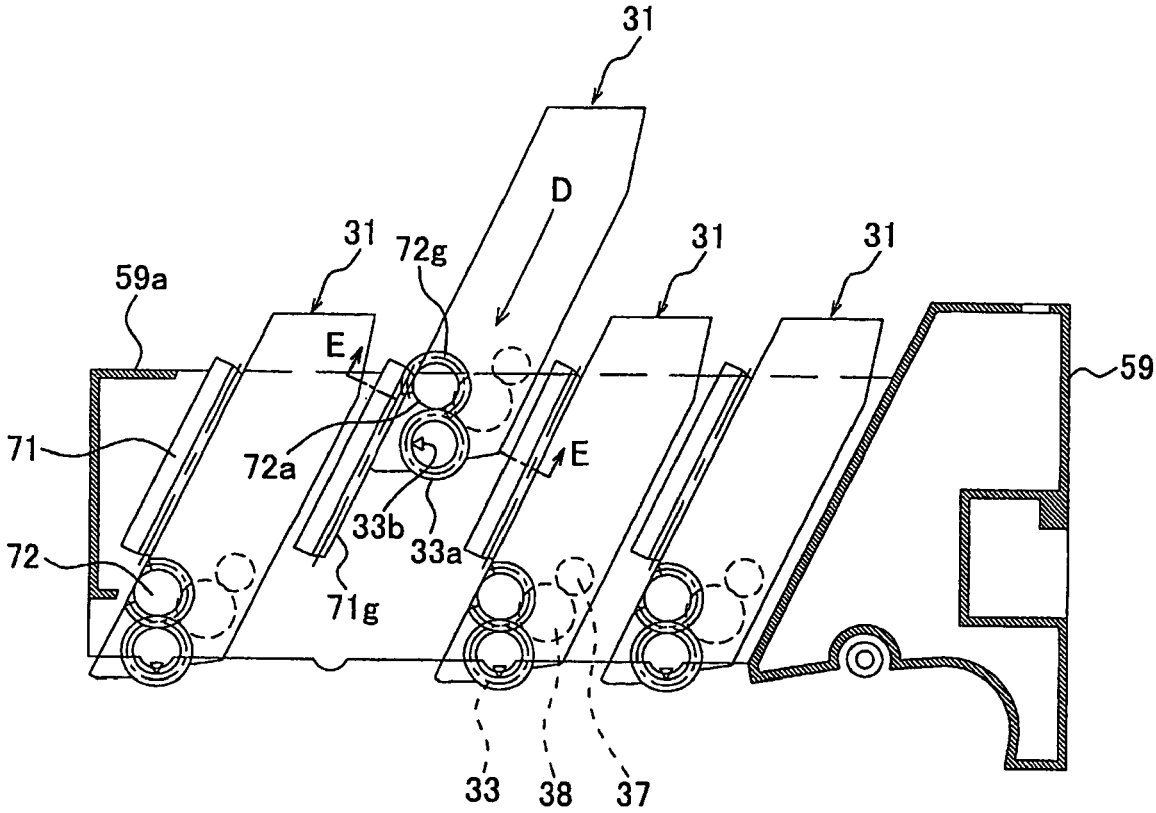
FIG. 10(*a*) is a side view showing a drum gear removing position restoring mechanism.
Figure 10B:
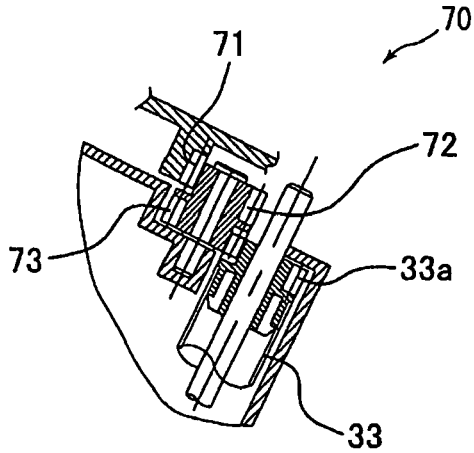

As shown in FIG. 10(*b*), the error position preventing mechanism 70 includes a rack bar 71, a partial toothed gear 72 and a common spur gear 73. The rack bar 71 is mounted on the process unit casing 59*a*, and the partial toothed gear 72 is mounted on the process unit 31. The rack bar 71 has rack teeth 71*g* that are arranged in line. The partial toothed gear 72 has a toothless section 72*a* and a toothed section 72*g*, and is configured to rotate together with the spur gear 73. The spur gear 73 is engaged with the drum gear 33*a* of the process unit 31. Therefore, the drum gear 33*a* also rotates when the toothed section 72*g* of the partial toothed gear 72 that is engaged with the rack teeth 71*g* of the rack bar 71 rotates.

The error position preventing mechanism 70 is configured so that the toothed section 72*g* opposes to the rack teeth 71*g* when the photosensitive drum 33 is in the drum gear removing positions 33*b*, while the toothless section 72*a* opposes to the rack teeth 71*g* when the photosensitive drum 33 is in a rotational position different from the drum gear removing positions 33*b*.

To mount the process units 31 in the process unit casing 59*a* of the second embodiment, the process units 31 are inserted in the D direction shown in FIG. 10(*a*). If the photosensitive drum 33 is stopped in the drum gear removing positions 33*b*, the toothed section 72*g* opposes to the rack teeth 71*g*. As the process units 31 are inserted in the D direction, the drum gear 33*a* rotates since the toothed section 72*g* is engaged with the rack teeth 71*g*.

However, if the drum gear 33*a* is stopped in a rotational position different from the drum gear removing positions 33*b*, the toothless section 72*a* opposes to the rack teeth 71*g* and the toothed section 72*g* is not engaged with the rack teeth 71*g*. Hence, even if the process units 31 are inserted in the D direction, the partial toothed gear 72 moves over the rack bar 71 without rotating. At this time, the drum gear 33*a* also moves without rotating. Accordingly, the error position preventing mechanism 70 prevents the drum gear 33*a* in a rotational position different from the drum gear removing position 33*b* from engaging the drum drive gear 61 when the photosensitive drum 33 is replaced.

With this construction, there is no need to restrict the rotational position of the drum gear 33*a* with the cover member 67 of fourth embodiment when the process unit 31 is removed from the process unit casing 59*a*.

While the invention has been described in detail with reference to the specific embodiment thereof, it would be apparent to those skilled in the art that various changes and modifications may be made therein without departing from the spirit of the invention. For example, any of the first through third embodiments may also be combined with either the fourth or fifth embodiment.

While the preferred embodiments are described for a direct transfer tandem color printer that conveys a recording medium and directly transfers toner images thereon, the present invention may also be applied to an intermediate transfer tandem (in-line) color printer employing an intermediate transfer belt.

What is claimed is:

1. An image-forming device comprising:

a plurality of photosensitive drums, each being in a cylindrical shape having a circumferential surface, a side surface and an axis extending from the side surface, each photosensitive drum being rotatable around the corresponding axis;

a plurality of drum gears provided in one-to-one correspondence with the plurality of photosensitive drums, each drum gear coaxially fixed to the axis of each photosensitive drum to be rotatable therewith, each drum gear having drum gear teeth and a first target portion;

a scanning unit that exposes the circumferential surface of each photosensitive drum to light to form an electrostatic latent image thereon;

a plurality of developing units disposed in one-to-one correspondence with the plurality of photosensitive drums, each developing unit storing a colored developer and supplying the corresponding circumferential surface with the developer to develop the corresponding electrostatic latent image;

a transferring unit that transfers the developed image on the circumferential surface of each photosensitive drum onto an image receiving member;

a casing that accommodates the plurality of photosensitive drums, each photosensitive drum being removable from the casing individually;

a plurality of drive gears disposed in one-to-one correspondence with the plurality of drum gears and provided on the casing, each drive gear having drive gear teeth and a second target portion, the drive gear teeth being meshingly engageable with the drum gear teeth of the corresponding drum gear; and a removal allowing unit that allows each photosensitive drum to be removed individually from the casing, and each corresponding drum gear and drive gear to be disengaged individually, only when the first target portion of the drum gear is positionally in coincidence with a first position and when the second target portion of the drive gear is positionally in coincidence with a second position.

2. The image-forming device according to claim 1, wherein the removal allowing unit comprises:

a sensor that detects the second target portion of the drive gear and outputs a signal; and a controller that determines whether the second target portion of the drive gear is in coincidence with the predetermined second position based on the signal output from the sensor.

3. The image-forming device according to claim 2, wherein when the second target portion of the drive gear is positionally in coincidence with the predetermined second position, the first target portion of the drum gear is positionally in coincidence with the predetermined first position.

4. The image-forming device according to claim 2, further comprising a plurality of motors, each driving a plurality of drive gears, wherein the sensor includes as many sensors as the plurality of motors.

5. The image-forming device according to claim 2, wherein the controller includes a processing unit and memory.

6. The image-forming device according to claim 1, wherein the removal allowing unit further includes an engaging mechanism, wherein the casing has a base surface, a top surface being formed with an opening, and a top cover that covers the top surface, wherein the engaging mechanism is configured to engage the top cover and maintain the top cover at a covering condition when engaged, the photosensitive drum being removable through the opening, and wherein the controller controls the engaging mechanism to engage the top cover at all times other than when the drum gear is in the first position and the drive gear is in the second position.

7. The image-forming device according to claim 6, wherein the engaging mechanism includes a pawl that is engagable with the top cover and a solenoid that operates the pawl, wherein the pawl engages the top cover when the solenoid is deenergized.

8. The image-forming device according to claim 1, wherein the removal allowing unit further includes an engaging mechanism, wherein the casing has a base surface, a top surface, and a side surface being formed with an opening, a side cover that covers the side surface, wherein the engaging mechanism is configured to engage the side cover and maintain the side cover at a covering condition when engaged, the photosensitive drum being removable through the opening, and wherein a controller controls the engaging mechanism to engage the side cover at all times other than when the drum gear is in the first position and the drive gear is in the second position.

9. The image-forming device according to claim 8, wherein the engaging mechanism includes a pawl that is engagable with the side cover and a solenoid that operates the pawl, wherein the pawl engages the side cover when the solenoid is deenergized.

10. The image-forming device according to claim 1, wherein the removal allowing unit further includes an engaging mechanism, wherein the casing has a base surface, a top surface being formed with an opening and a top cover that covers the top surface, and the photosensitive drum is removable through the opening, wherein the engaging mechanism is configured to engage a part of the casing and maintain the top cover at a covering condition when engaged, and wherein a controller controls the engaging mechanism to engage the part of the casing at all times other than when the drum gear is in the first position and the drive gear is in the second position.

11. The image-forming device according to claim 9, wherein the engaging mechanism includes a pawl that is engagable with the part of the casing and a solenoid that operates the pawl, wherein the pawl engages the part of the casing when the solenoid is deenergized.

12. The image-forming device according to claim 1, wherein the removal allowing unit further includes an engaging mechanism, wherein the casing has a base surface, a top surface, a side surface being formed with an opening and a side cover that covers the side surface, and the photosensitive drum is removable through the opening, wherein the engaging mechanism is configured to engage a part of the casing and maintain the side cover at a covering condition when engaged, and wherein a controller controls the engaging mechanism to engage the part of the casing at all times other than when the drum gear is in the first position and the drive gear is in the second position.

13. The image-forming device according to claim 12, wherein the engaging mechanism includes a pawl that is engagable with the part of the casing and a solenoid that operates the pawl, wherein the pawl engages the part of the casing when the solenoid is deenergized.

14. The image-forming device according to claim 1 further comprising:

a plurality of process units holding each photosensitive drum, and a rotation preventing mechanism that prevents the drum gear from rotating for each photosensitive drum when the photosensitive drum is removed from the casing.

15. The image-forming device according to claim 14, wherein the rotation preventing mechanism has a cover member that covers the drum gear when the photosensitive drum is removed from the casing.

16. The image-forming device according to claim 15, wherein the rotation preventing mechanism further includes a first bias member configured to bias the cover member so that the cover member covers the photosensitive drum and a second bias member configured to bias the cover member so that the cover member exposes the photosensitive drum, wherein a biasing force of the first bias member is larger than a biasing force of the second bias member when the photosensitive drum is removed from the casing, and the biasing force of the second bias member is larger than the biasing force of the first bias member when the photosensitive drum is mounted on the casing.

17. The image-forming device according to claim 14, wherein the rotation preventing mechanism has an engaging pawl that engages the drum gear teeth when the photosensitive drum is removed from the casing.

18. The image-forming device according to claim 1 further comprising an error position preventing mechanism corresponding to each photosensitive drum, each said error position preventing mechanism preventing the corresponding drum gear from engaging the corresponding drive gear when the photosensitive drum is mounted in the casing if the first target portion of said drum gear is in a position different from the first position.

19. The image-forming device according to claim 18, wherein the error position preventing mechanism comprises:

a process unit that holds the photosensitive drum;

a spur gear mounted on the process unit and having spur gear teeth that meshingly engage the drum gear teeth;

a rack bar disposed in the casing and having rack teeth; and a partial toothed gear mounted on the process unit and having a toothless section and a toothed section, the partial toothed gear rotating together with the spur gear, wherein the toothed section of the partial toothed gear engages the rack teeth of the rack bar only when the first target portion of the drum gear is positionally in coincidence with the first position.

20. The image-forming device according to claim 19, wherein the rack teeth of the rack bar are arranged in line along a direction in which the process unit is mounted.

* * * * *